United States Patent [19]

Huehne

[11] 4,363,443

[45] Dec. 14, 1982

[54] GAS-TORCH CONSTRUCTION

[75] Inventor: Erwin D. Huehne, Schallstadt, Fed. Rep. of Germany

[73] Assignee: Eutectic Corporation, Flushing, N.Y.

[21] Appl. No.: 191,132

[22] Filed: Sep. 26, 1980

[51] Int. Cl.[3] ..... B05B 7/20

[52] U.S. Cl. ..... 239/79; 239/419.3; 239/422; 239/424

[58] Field of Search ..... 239/79, 85, 419, 419.3, 239/422, 424, 424.5, 426, 427–428

[56] References Cited

U.S. PATENT DOCUMENTS 1,917,750 7/1933 Campbell, Jr. ..... 239/419.3 X
2,348,110 5/1944 Crowley ..... 239/424.5 X

FOREIGN PATENT DOCUMENTS 133003 7/1946 Australia ..... 239/419

*Primary Examiner*—Andres Kashnikow

*Attorney, Agent, or Firm*—Hopgood, Calimafde, Kalil, Blaustein & Judlowe

[57] ABSTRACT

The invention contemplates a gas-torch construction wherein independent flows of combustible gases are maintained up to the point of mixing within the nozzle of the torch, virtually at the location of discharge from the nozzle. The nozzle is removably connected to an elongate intermediate or adapter member, and the latter is removably connected to the torch body. The separate flows of the gases are maintained independent of each other, from the torch body, through the adapter member, and into the upstream end of the mixing nozzle. Individual radially spaced manifolds at the adapter-to-nozzle connection assure independence of the gas flows and a non-critical angular relation when the nozzle is replaced. The invention is described in application to a powder-spraying gas torch, as for torch deposition of metal coatings.

19 Claims, 19 Drawing Figures

GAS-TORCH CONSTRUCTION

BACKGROUND OF THE INVENTION

The present invention relates to a backfire-resistant gas-torch construction, as for applying metallic coating material to a substrate. The invention has application to gas-torch configurations other than for flame deposition of metal coatings; for example, the invention is applicable to such gas-torch employments as welding, surface-melting, cutting, flaming, and flame-depositions other than of metal. However, the presently disclosed embodiments have metal-coating capability. The term "backfire-resistance" as presently used shall imply that gas-mixture explosions within the torch or applicator are avoided.

Applicators of the backfire-resistant type have recently become known and have been used especially for powder flame spraying, with the backfire resistance being safeguarded by special nozzle formations. Previous systems, with nozzles, had been supplied with combustible-gas components which were mixed and therefore ignitable and explosive at a location upstream from the nozzle. In a more recent construction, mixing is no longer effected at a suitable point within the device but rather within the nozzle itself, the mixing being substantially only immediately prior to discharge from the nozzle.

"Internally mixing" nozzles have been known per se from cutting torches in which the backfire-resistance requirement is not as important as with devices for applying metallic coatings. The internally mixing cutting-torch nozzles have involved different approaches to a solution, but these approaches have not been entirely satisfactory.

Although highly desirable, the provision of conventional torch systems with backfire-resistant, internally mixing nozzles has not been possible, without development of a special device uniquely designed to serve the particular nozzle. And it should be noted that, in contrast to simple welding and cutting torches, the provision of powder flame-spraying capability presents special problems of accommodating the mixing and supply of powder with carrier gas, the sealing of metal connecting faces, etc. within a minimum of available spaces. These problems are aggravated by the fact that component-gas supply-line terminations at the torch body generally do not register with corresponding connection openings of the internally mixing nozzle; for example, a connection of the nozzle to the torch body (which is, as a rule, of gun or pistol-shaped configuration) is prevented, due to mismatch or non-symmetry of connection relationships.

In the indicated recently known system, this connection problem has not been solved optimally, in that a fixed stationary block has been incorporated into the system, with small individual tubes provided for conduct of the gas-component flows to the nozzle-connecting face. To assure a proper operation of the device, the nozzle must be clamped firmly and closely against the metal connecting face of the block. Such clamping usually requires use of a vise or the like, thus presenting a particular disadvantage in coating operations, where nozzle replacement is frequently required, it being noted that the vise or the like is also needed to unscrew the nozzle clamp for nozzle replacement.

Apart from the fact that it is thus necessary to clamp the whole of the system in a complicated manner, it is not only possible for the housing to become externally damaged, but damage can also occur to the metallic sealing face, e.g., by unnoticed small powder particles that may remain as a result of repeated assembly and disassembly of the nozzle. Moreover, the multiple passages required by existing mixing-nozzle devices present unusual problems of sealing all connections, making it unavoidable to use thermally loadable soft-ring seals. And the heat developed at the nozzle can dissipate only via the torch body, causing excessive heat at the connection area for the powder-storing vessel.

BRIEF STATEMENT OF THE INVENTION

It is an object of the invention to provide an improved gas-torch construction, of the internally mixing-nozzle variety.

Another object is to provide a backfire-resistant gas torch, avoiding problems of prior constructions.

A further object is to provide such a torch which does not require clamping the torch body, in order to remove and replace the nozzle.

It is also an object to provide such a torch wherein nozzle-replacement is a simple hand-held operation, involving damage-free treatment of sealing faces, and use of thermally loaded sealing rings only at a location that is relatively remote from the nozzle.

Another object is to provide means for detachably connecting an internally mixing nozzle to a torch body, whether or not the upstream connection ends of the nozzle passages are aligned with the downstream connection ends of the various supply passages of the torch body.

The invention achieves the foregoing objects and other features, by providing a special intermediate adapter unit, having an upstream end with removable connection to the torch body and a downstream end with removable connection to the mixing nozzle. Independence of flows of combustible-gas components is preserved throughout the intermediate adapter unit, and the nozzle connection preserves this independence, without calling for any critical angular orientation at the connection. Elastomeric seals are avoided at the nozzle connection, but they may be safely used at the connection of the adapter unit to the torch body.

The invention makes possible easy and safe removable connection of a new nozzle by treating the mixing nozzle and its non-mixing adapter unit as a separate subassembly, so that the point of removable connection to the torch body is safely "thermally remote" from the mixing nozzle, i.e., from the source of heat development in the apparatus. Replacement of the nozzle and its adapter unit is a simple matter of manual rotation of a threaded coupling collar, and plug-in assembly of the adapter-to-torch body connection. An inventory of new mixing nozzles, preassembled to adapter units of the invention, assures minimum torch shut-down time, to accomplish a nozzle change.

Since the internally-mixing nozzle provides only the smallest of volume for accomplishment of mixing, and since this is virtually at the point of nozzle discharge, there is a minimum base for heat development in the apparatus, and, for the indicated case of nozzle-to-adapter preassembly, this heat source is necessarily even more remote from the point of detachable connection to the torch body. Specifically, since no mixing can occur in the adapter unit, there can be no potential source of heat development in the adapter unit. The concept of such a non-mixing adapter unit thus lends itself to utilization not only for the in-line arrangements herein described, but also for bent-nozzle or extended-nozzle arrangements wherein the axis of mixing-nozzle discharge is either angularly offset from the longitudinal orientation of gas supply through the adapter unit or is more extensively longitudinally offset from the torch body, thus involving even larger "thermal distances" to the point of detachable connection to the torch body.

DETAILED DESCRIPTION

The invention will be illustratively described in detail in connection with the accompanying drawings, in which.

Figure 1:
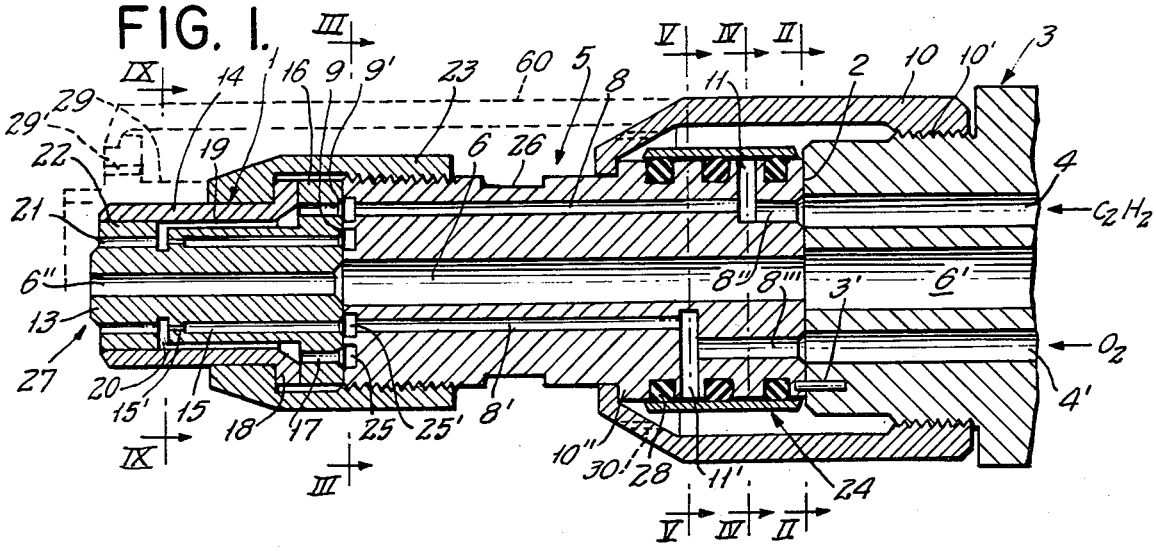
FIG. 1 is a longitudinal sectional view, taken along the axis of the head end of a gas torch of the invention.
Figure 2:
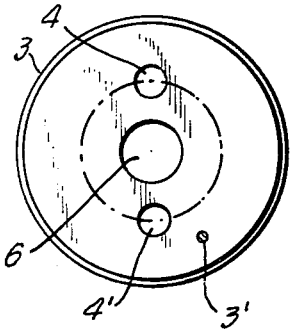
FIG. 2 is an end view of the upstream-end connecting face of one of the components of FIG. 1, the view being taken at II—II of FIG. 1.
Figure 3:
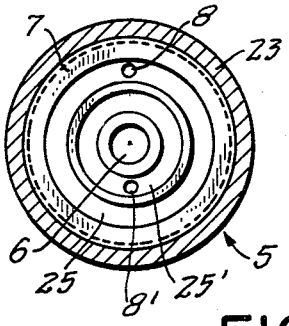
FIG. 3 is an end view of the downstream-end or nozzle-connecting face of the component of FIG. 2, the view being taken at III—III of FIG. 1.

FIG. 1 illustrates the entire head of a powder flame-spraying system embodying the invention, it being understood that only the nozzle-connecting region of a torch body 3 is needed for the illustration. Thus, the torch body 3 will be understood to be of conventional configuration, as for example a gun shape, with pistol grip (not shown). The torch body 3 will further be understood to be provided with separate means of supply for a flow of powder with carrier gas, a flow of fuel gas (such as acetylene) and a flow of oxygen, all open for independent downstream discharge as at a circular connection face, at the plane II—II of FIG. 1; as shown, a central passage 6' supplies the flow of powder with carrier gas, a first radially offset passage 4 accommodates the flow of fuel gas, and a second radially offset passage 4' (angularly offset from passage 4) accommodates the flow of oxygen. In accordance with the invention, these flows are maintained separate in their passage to an internally mixing nozzle 1, via an intermediate adapter member 5.

As shown, the adapter member 5 is generally cylindrical and elongate. It is characterized by a short radial flange 10'' for engagement by a clamp sleeve or coupling 10, having threaded engagement at 10' to torch body 3. An index or key pin 3' carried by body 3 projects for angularly keyed location of adapter 5 to body 3, to assure registering alignment of torch-body passages 6'-4-4' with inlet openings passages 6-8''-8''', respectively, at the upstream end face 2 of the adapter 5. The powder-flow passages 6'-6 communicate with a similar central passage 6'' in nozzle 1 and thus establish a first through-passage via the connected members 3-5-1, with discharge centered on the nozzle-discharge axis.

Figure 4:
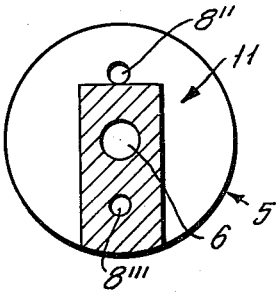
FIG. 4 is a sectional view taken at IV—IV of FIG. 1.
Figure 5:
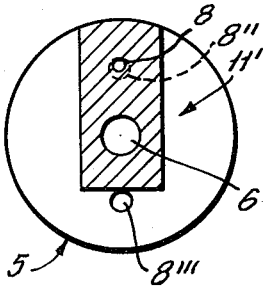
FIG. 5 is a sectional view taken at V—V of FIG. 1.

To enable unmixed flows of fuel gas and of oxygen to have independent entry into the mixing nozzle 1, the downstream connecting end face 7 of adapter member 5 and the fitted adjacent upstream end face of nozzle 1 have cooperating formations which establish independent radially separated annular manifolds. As shown, such formations are in adapter member 5 and comprise a radially outer groove 25 for fuel-gas manifolding and a radially inner groove 25' for oxygen manifolding; these grooves 25–25' become completed manifolds in the context of the fitted flat upstream connecting-end face of the nozzle 1, there being a first distributed plurality of nozzle-inlet passages 17 open exclusively to the fuel-gas manifolding groove 25, and a second distributed plurality of nozzle-inlet passages 15 open exclusively to the oxygen manifolding groove 25'; these nozzle-inlet passages 15–17 are shown with chamfered upstream ends 9–9'. The fuel-gas manifolding groove 25 is served by one or more elongate passages 8 within the radius range of groove 25 and communicating with a first distributor slot 11 near the upstream end of adapter member 5; slot 11 is seen in FIGS. 1 and 4 to be served exclusively by the fuel-gas inlet port 8'', and the exclusivity is assured by a closure sleeve 24 sealing off slot 11 via adjacent elastomeric O-ring seals, on opposite axial sides of slot 11. In similar fashion, a second distributor slot 11' serves one or more oxygen passages 8' which communicate with the manifold groove 25'; slot 11' is seen in FIGS. 1 and 5 to be served exclusively by the oxygen inlet port 8''', and the exclusivity is assured by the same sleeve 24 sealing off slot 11' via O-ring seals on opposite axial sides of slot 11'.

While it has been indicated that plural spaced parallel passages 8(8') may connect slots 11(11') with grooves 25(25'), it will be appreciated that this is not absolutely necessary, since in each case a single passage 8 or a single passage 8' will suffice. In either event, the manifolding grooves 25–25' aid in promoting circumferentially uniform distribution of each of the independent flows of the gases, to be mixed only within nozzle 1.

With the structure thus far described, it is seen that the intermediate adapter member 5 performs the following five functions:

- Conducting and maintaining the continued separation of gas components supplied to the nozzle;
- Transposing the delivery of gas components, from the angularly offset relation of torch-body delivery passages 4–4', to their radially spaced concentric independent delivery at manifolding grooves 25–25';
- The possibility of enhancing uniform circumferential delivery of each of the gas components, by providing plural angularly spaced passages 8 for fuel-gas delivery to manifold 25 and by providing plural angularly spaced passages 8' for oxygen delivery to manifold 25';
- A preassembly support and mounting function for the nozzle 1, making it a much simplified procedure to replace the nozzle by replacing a nozzle (1) plus adapter (5) preassembly, specifically avoiding the need to use a wrench or vise whenever replacing a nozzle, in the course of a particular job; and
- A thermal-isolation function, by substantially extending the distance between the torch body and the source of heat (at and beyond to point of combustible-gas mixing), and by providing substantially greater heat-sink mass and heat-dissipating surface area within this extended distance.

The internally mixing nozzle 1 of FIG. 1 comprises two flanged cylindrical members 13–14, force-fitted to each other, with their respective flanges 16–18 nested in axial adjacency. The central one (13) of these members has a central bore to define the nozzle portion 6'' of the powder-flow passage. The central member 13 also has plural angularly spaced oxygen-supply passages 8', but alignment registry of passages 15 with passages 8' is not required, in view of the circumferential manifolding function of groove 25'. Near the downstream end of the central member 13, a radially outward circumferential groove 20 radially overlaps and therefore intersects the alignment axes of the oxygen supply passages 15, and downstream from groove 20 the same alignments are continued for a corresponding plurality of independent angularly spaced gas-mixing passages to supply and maintain an annular pattern of flaming discharge from the nozzle, and surrounding the central discharge of powder and carrier gas issued by passage 6''. As shown, the oxygen-supply passages 15 are reduced at 15' to develop independent jets of oxygen discharge across groove 20 and into the center of each corresponding gas-mixing passage 21.

The downstream end region 22 of central member 13 is preferably slightly conically tapered, being in press-fitted and therefore effectively sealed assembly to the bore of the outer-sleeve member 14, but in the axial region between groove 20 and flange 16, the outer cylindrical surface of central member 13 is relieved to establish a circumferentially continuous annular gap or manifold 19, serving fuel-gas supply to the groove 20. The upstream end of the bore of sleeve member 14 is chamfered, to the extent of radially overlapping fuel-gas supply passages 17 in the flange 16 of central member 13 and in radial registry with the annulus of manifolding groove 25. The action of oxygen-jet discharge from restrictive orifices 15, across groove 20 and into the individual mixing passages 21, is to entrain or aspirate fuel gas from the manifolding groove 20 and into the mixing passage 21; of course, mixing begins with oxygen entry into groove 20, so that groove 20 is sometimes referred to as a mixing manifold, even though substantially all mixing takes place in the individual subdividing volumes of passages 21. Thus, it is only in this relatively short longitudinal space, virtually adjacent the nozzle-discharge face, that the two combustible-gas components are mixed, meaning not only that an extremely small volume of pre-ignitable mixture is available for flashback, and also meaning that this extremely small volume is further subdivided by localized mixing in an angularly distributed plurality of the mixing passages.

The described nozzle 1, i.e., comprising the force-fitted central and sleeve parts 13–14, may be removably clamped (via the flanges 18–16 of these parts) to the downstream end of the intermediate adapter member 5, by means of a sleeve coupling 23 having threaded engagement to adapter 5, in the manner already described for the sleeve 10 which removably couples adapter 5 to the torch body 3. And, as indicated above, it is preferred, in advance of torch use, to prepare preassemblies of each nozzle 1 with an associated adapter member 5, so that nozzle replacement can involve only a simple manual operation of the coupling sleeve 10, to accomplish a nozzle replacement in the course of a given job.

Figure 6:
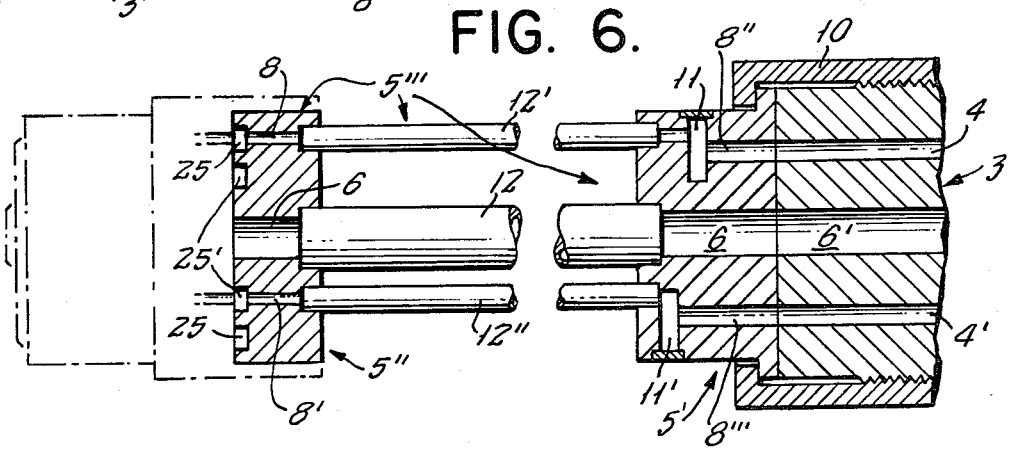
FIG. 6 is a simplified view, partly in longitudinal section, of another embodiment.
Figure 7:
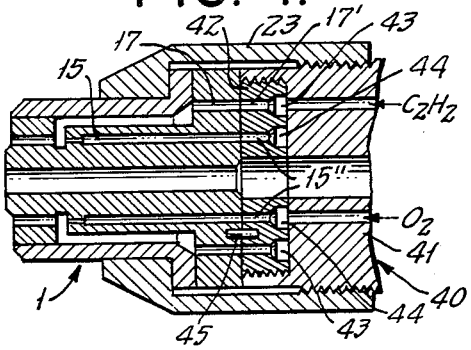
FIGS. 7 and 8 are views similar to FIG. 1, to show additional embodiments.

FIG. 6 illustrates a modification of the structure described in connection with FIGS. 1 to 5, the principal difference being that the adapter-member assembly 5''' of FIG. 6 is itself an assembly of multiple parts, as distinguished from the more solid-body form of adapter member 5. More specifically, the adapter member 5''' comprises separate end-connection heads 5'–5'', with connecting tubes 12-12'–12'' to establish and maintain the requisite independence of flows. Thus, the upstream head 5' embodies part of the central passage 6, as well as the separate inlet passages 8'' and 8''' for independent combustible-gas component supply to the respective slotted gas-distribution regions 11–11', the latter being closed at their radially outer limits; and the downstream head 5'' includes part of the central passage 6, as well as the manifolding grooves 25–25' and associated ends of fuel-gas and oxygen supply passages 8–8'. The connecting tubes 12-12'–12'' have brazed or otherwise secured connection to appropriate counterbored regions of heads 5'–5''. Connection to nozzle 1 and to torch body 3 will be understood to be otherwise as described for FIG. 1. It will also be understood that for the form of FIG. 6, it is not absolutely necessary to employ the distributor-slot technique illustrated at 11–11', in that a small bending offset in the formation of connection tubes 12'–12'' may enable direct connection of tube 12' from the inlet passage 8'' to the downstream passage 8, and direct connection of inlet passage 8''' to the downstream passage 8'.

The adapter member 40 in the embodiment of FIG. 5 will be recognized for its points of similarity with adapter 5 of FIG. 1 and therefore the same reference numerals are used, where applicable. The point of difference is that the independent annular manifolding for each of the gas-component flows is accomplished within the body of the adapter, here shown as comprising a primary elongate body member 41 (having a large threaded bore at its downstream end) and a secondary body member or plug 42 assembled to the threaded bore of member 41. The radially spaced manifolding grooves 43–44 are formed in the upstream end of plug 42, for independent registration with the one or more fuel-gas passages 8 and oxygen flow passages 8', respectively. Plug 42 also includes discharge passages 15'' in plurality and orientation for communication with nozzle-inlet passages 15, as well as further passages 17' for similar communication with nozzle-inlet passage 17, a keying-pin 45 being provided to assure the requisite alignment.

Figure 8:
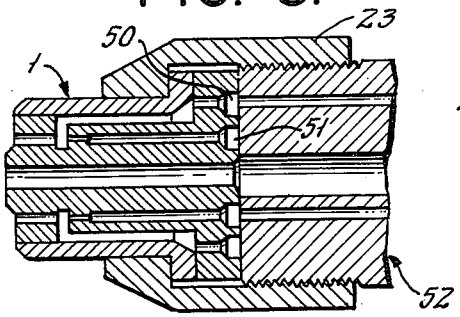

The arrangement of FIG. 8 is to show that if desired, the radially spaced annular manifolding desired at the nozzle-to-adapter connection may also be achieved by suitably forming annular grooves 50–51 in the upstream connecting face of the nozzle 1, for radial registration either with grooves 25–25', or with merely the respective passages 8–8' at a flat radial-plane downstream end face of the adapter member 52.

Figure 9:
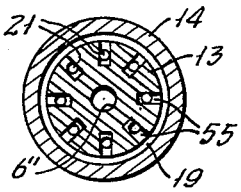
FIG. 9 is a sectional view, taken at IX—IX of FIG. 1, to show a modified construction for part of the combustible-gas mixing section of the nozzle.

In the nozzle construction of FIG. 1, it has been explained that although most mixing of the combustible-gas components proceeds within the volume of each of the plural mixing passages 21, the mixing process actually begins as the individual jet discharges of oxygen (from orifices 15') traverse the mixing manifold 20. As a practical matter, the oxygen is always supplied at a pressure that is substantially elevated with respect to the pressure of fuel gas, so that fuel gas distributed circumferentially in the mixing manifold 20 is effectively aspirated or drawn into the plural mixing passages for equal plurality of localized mixings of the combustible components. However, to the extent that the commencement of mixing may involve dispersion of the mixed gases from one to an adjacent passage 21 via manifold 20, the theoretical possibility exists that a flashback in one passage 21 might involve a spread of the flashback within manifold 20 and into the adjacent passage 21. As assurance against this more remote eventuality, FIG. 9 shows that the annular manifold 20 of FIG. 1 may be replaced by a plurality of radially inwardly drilled passages 55 in the central nozzle member 13, each such passage 55 providing fuel-gas segregation from the extensive annular manifold 19 to a different one of the regions of oxygen-jet discharge from orifices 15'. Such a construction literally assures segregation of each of the gas components into correspondingly and fully segregated mixing for each of the respective mixing passages 21.

The described embodiments will be seen to achieve all stated objects and to provide an important contribution to the efficient use of gas torches of the character indication, whether or not used or intended for flame sprayed deposition of coating materials. In all cases, nozzle replacement becomes a simple handheld operation, made simple by use of intermediate adapter means of the invention. Furthermore, by assuring segregated gas-component mixing only in the immediate vicinity of flame discharge, backfiring is avoided, and the source of heat development is so very much more remote from the point of severable connection to the torch body that elastomeric seals (28) at or near the point of such severable connection are feasible and are not damaged. If, in spite of this fact, additional cooling is deemed necessary, the available annular space within coupling sleeve 10 may be supplied with a pressurized flow of cooling air, exhausting for example via passages 30 in sleeve 10. In similar fashion, by using a flanged ring member 29 (fitted over nozzle-sleeve part 22 and against coupling sleeve 23) having exhaust passages 29', and by extending the coupling member to the additional length suggested by a sleeve 60, the entire annular space within sleeve 60 may be coursed with a pressurized flow of cooling air, discharging as via the exhaust passages 29'.

Since it is recommended to provide an inventory of mixing nozzles 1, each with its own preassembled adapter member 5, such preassembly may be performed in a service area apart from the torch-application area, clamping tools such as wrenches being more readily available in the service area. To facilitate wrench application and removal of the clamped nozzle-to-adapter preassembly, the clamp sleeve 23 and the body region 26 of adapter 5 are preferably chracterized by wrench flats.

While the invention has been described in detail for preferred forms, it will be understood that modifications may be made without departure from the claimed scope of the invention.

What is claimed is:

1. Backfire-resistant gas-torch apparatus, comprising a torch body having an independent supply passage for each of two combustible-gas components, which passages extend to a replaceable nozzle at the head end of the apparatus, with the gas-components supply passages extending independently into and interconnecting within the nozzle for mixing the gas components, characterized in that the upstream end of the nozzle and the downstream end of the torch body terminate in flat radial planes, and that an intermediate adapter element (5) with flat radial-plane upstream and downstream ends is coupled between the upstream end of the internally mixing nozzle (1) and the downstream end of the torch body (3), said adapter element (5) having corresponding passages (8, 8') which independently extend via said adapter element (5) and interconnect the orifices of the connecting end (7) of the nozzle (1) with the corresponding connecting orifices of the connecting face (2) of the torch body (3), and fastening means removably securing the nozzle (1) and the adapter element (5) to each other and to the torch body (3) via the respective flat downstream and upstream ends of the adapter element (5).

2. Apparatus according to claim 1, in which said nozzle (1) and adapter element (5) have cooperating adjacent-end formations establishing first and second radially separate annular manifolds (25, 25'), each such manifold defining part of the supply passage for a different one of the combustible-gas components.

3. Backfire-resistant gas-torch applicator apparatus for applying metallic coating material to a metallic substrate to be coated, comprising a torch body having supply passages for combustible gas components and having a supply passage for the coating material, which passages extend to a replaceable nozzle at the applicator head, with the gas-components supply passages extending into the nozzle being combined therein for mixing the gas components, characterized in that arranged between the internally mixing nozzle (1) and the connecting face of the torch body (3) is an intermediate adapter element (5) abutting the torch-body connecting face or being insertable thereinto and having corresponding passageways or supply and feed channels (6, 8, 8'), with the passageways extending separately in the intermediate element (5) and interconnecting the connecting orifices of the nozzle-connecting side (7) with the corresponding connecting orifices of the connecting face of the torch body (3), and fastening means removably securing the nozzle (1) and the intermediate element (5) to the torch body (3).

4. Apparatus according to claim 3, wherein gas-components supply lines (8'', 8''') in the intermediate adapter element (5) are in alignment with corresponding gas-component orifices in the connecting face of the torch body (3) and respectively lead to separate and radially outwardly directed gas-component distributor slots (11, 11'), there being from each of said slots at least one individual passage (8, 8') leading to the corresponding connecting orifices of said nozzle (1), whereby an unmixed independent supply of each gas component is maintained at least as far as its connection to the corresponding connecting orifice of said nozzle.

5. Apparatus according to claim 3, in which the intermediate adapter element (5) comprises two spaced partial members (5, 5'') interconnected by separate tubes (12, 12', 12'') corresponding to the respective gas-component supply passages and the supply passage for the coating material.

6. Apparatus according to claim 3, in which the internally mixing nozzle (1) is formed of a flanged central part (13) and a flanged sleeve part (14), the supply passage (6) for the coating material being disposed in the central part (13), a plurality of passages (15) for one gas component being disposed in the central part (13) about the supply passage for the coating material, and a plurality of passages (17) for another gas component being disposed in the flange (16) of the central part (13), the flanges (16, 18) of the central part (13) and of the sleeve part (14) being correspondingly large, adjacent spaced surfaces of said parts (13, 14) defining an annular manifold passage 19 communicating with passages (17) in the flange (16) of the central part (13), said manifold passage (19) terminating in a gas-mixing slot (20), the sleeve part (14) surrounding and being otherwise in sealed relation to the central part (13) in the region of gas-mixing passages (21) in said central portion (13) and emerging from the gas-mixing slot (20).

7. Apparatus according to claim 6, in which the region of sealed relation (22) between the central part (13) and the sleeve part (14) is characterized by slightly conical fitted surfaces.

8. Apparatus according to claim 3, in which said fastening means includes a sleeve coupling element (23) detachably securing the flanges (16, 18) of the central and sleeve parts (13, 14) to the intermediate element (5), and a further sleeve coupling element (10) detachably securing the intermediate element (5) to the torch body, whereby the nozzle (1) and intermediate element (5) comprise a unit-handling subassembly which is detachably secured to the torch body.

9. Apparatus according to claim 4, in which the gas-component distributing slots (11, 11') are disposed in the intermediate-element region (24) which is near the torch-body connecting face (2).

10. A gas torch comprising a torch body including two passages for independent supply of an oxygen flow and a fuel-gas flow, an elongate adapter member having two inlet passages at its upstream end for removably sealed connection to the respective passages of said torch body, a gas-mixing nozzle member adapted to fit the downstream end of said adapter member and said nozzle member having a central axis of symmetry of mixed-gas discharge at its downstream end, and clamp means spanning said nozzle member and body for removably securing the assembled relation of said nozzle member and said adapter member to said body; said nozzle and adapter members having adjacent-end configurations which in the secured relation establish first and second annular gas manifolds radially spaced from and independnet of each other; said adapter member having first passage means providing communication only between one of said gas manifolds and the oxygen-flow passage of said torch body and second passage means providing communication only between the other of said gas manifolds and the fuel-gas passage of said torch body; said nozzle member further having an annular gas-mixing manifold near its downstream end and a plurality of separate passages independently connecting said respective annular gas manifolds to angularly spaced regions of said gas-mixing manifold, and said nozzle member having a further plurality of mixed-gas discharge passages in angularly spaced relation about said axis and establishing mixed-gas flow communication from said mixing manifold to angularly spaced discharge locations around said axis.

11. A gas torch for powder-spraying or flaming, said torch comprising a torch body including three passages for independent supply of a powder or other flow and an oxygen flow and a fuel-gas flow, an elongate adapter member having three inlet passages at its upstream end for removably sealed connection to the respective passages of said torch body, a gas-mixing nozzle member adapted to fit the downstream end of said adapter member, and clamp means spanning said nozzle member and body for removably securing the assembled relation of said nozzle member and said adapter member to said body; said nozzle and adapter members having adjacent-end configurations which in the secured relation (a) establish a central through-passage communicating with the powder or other flow body passage and discharging the same at the downstream end of said nozzle member, and (b) establish first and second annular gas manifolds radially spaced from and independent of said through-passage and radially spaced from and independent of each other; said adapter member having first passage means providing communication only between one of said gas manifolds and the oxygen-flow passage of said torch body and second passage means providing communication only between the other of said gas manifolds and the fuel-gas passage of said torch body; said nozzle member further having an annular gas-mixing manifold near its downstream end and a plurality of separate relatively long passages independently connecting said respective annular gas manifolds to angularly spaced regions of said gas-mixing manifold, and said nozzle member having a further plurality of relatively short mixed-gas discharge passages establishing mixed-gas flow communication from said mixing manifold to angularly spaced discharge locations around the through-passage.

12. As an article of manufacture, an adapter for removably upstream-end fitment to a gas torch and having means at its downstream end for receiving removably fitment of a gas-mixing nozzle, said adapter comprising an elongate body having a central axis, said body having first through-passage means for independent supply of oxygen to the fitted nozzle and second through-passage means for independent supply of fuel gas to the fitted nozzle, said first and second through-passage means having single upstream-end openings which are separate from each other at the upstream end of said adapter; said first through-passage comprising a first annular manifold formation at the downstream end of said body at a first radius range with respect to said axis, said first annular manifold formation being for coaction with a first angularly distributed plurality of fitted-nozzle openings for independently communicating first-manifold gas to the fitted nozzle; said second through-passage means comprising a second annular manifold formation at the downstream end of said body at a second radius range with respect to said axis and radially spaced from said first range, said second annular manifold formation being for coaction with a second angularly distributed plurality of fitted-nozzle openings for independently communicating second-manifold gas to the fitted nozzle; said first and second pluralities of openings being within different geometrical annuli about and radially spaced from said axis, said geometrical annuli being radially spaced from each other, said first and second manifold formations being independent radially spaced annular grooves in the downstream end of said adapter.

13. As an article of manufacture, an adapter for removably upstream-end fitment to a gas torch and having means at its downstream end for receiving removably fitment of a gas-mixing nozzle, said adapter comprising an elongate body having a central axis, said body having first through-passage means for independent supply of oxygen to the fitted nozzle and second through-passage means for independent supply of fuel gas to the fitted nozzle, said first and second through-passage means having single upstream-end openings which are separate from each other at the upstream end of said adapter; said first through-passage comprising a first annular manifold formation at the downstream end of said body at a first radius range with respect to said axis, said first annular manifold formation being for coaction with a first angularly distributed plurality of fitted-nozzle openings for independently communicating first-manifold gas to the fitted nozzle; said second through-passage means comprising a second annular manifold formation at the downstream end of said body at a second radius range with respect to said axis and radially spaced from said first range, said second annular manifold formation being for coaction with a second angularly distributed plurality of fitted-nozzle openings for independently communicating second-manifold gas to the fitted nozzle; said first and second pluralities of openings being within different geometrical annuli about and radially spaced from said axis, said geometrical annuli being radially spaced from each other, said first and second manifold formations being flat radial surfaces at the downstream end of said adapter for independent coaction with radially spaced annular grooves in the adjacent upstream end of the fitted nozzle.

14. As an article of manufacture, an adapter for removable upstream-end fitment to a powder-spraying or flaming gas torch and having means at its downstream end for receiving removable fitment of a gas-mixing powder-spraying or flaming nozzle, said adapter comprising an elongate body having a central through-passage for supply of powder or other flow from the torch to a fitted gas-mixing nozzle, said body having second through-passage means for independent supply of oxygen to the fitted nozzle and third through-passage means for independent supply of fuel gas to the fitted nozzle, said second and third through-passage means having single upstream-end openings which are radially offset from said central through-passage and angularly offset from each other at the upstream end of said adapter; said second through-passage means comprising a first annular manifold formation at the downstream end of said body at a first radius range outside the central passage, said first annular manifold formation being for coaction with a first angularly distributed plurality of fitted-nozzle openings for independently communicating first-manifold gas to the fitted nozzle; said third through-passage means comprising a second annular manifold formation at the downstream end of said body at a second radius range outside the central through-passage, said second annular manifold formation being for coaction with a second angularly distributed plurality of fitted-nozzle openings for independently communicating second-manifold gas to the fitted nozzle; said first and second pluralities of openings being within different geometrical annuli about and radially spaced from the central through-passage, and said geometrical annuli being radially spaced from each other.

15. As an article of manufacture, an adapter for removable upstream-end fitment to a gas torch and having means at its downstream end for receiving removable fitment of a gas-mixing nozzle, said adapter comprising an elongate body having a central axis, said body having first through-passage means for independent supply of oxygen to the fitted nozzle and second through-passage means for independent supply of fuel gas to the fitted nozzle, said first and second through-passage means having single upstream-end openings which are separate from each other at the upstream end of said adapter; said first through-passage means comprising a first annular manifold within said body at a first radius range, and an angularly distributed plurality of like passages for discharging first-manifold gas at a first corresponding plurality of downstream-end openings; said second through-passage means comprising a second annular manifold within said body at a second radius range, and an angularly distributed plurality of like passages for discharging second manifold gas at a second plurality of downstream-end openings.

16. The article of claim 15, in which said first and second pluralities of openings are within different geometrical annuli about and radially spaced from said axis, said geometrical annuli being radially spaced from each other.

17. In a gas-mixing torch nozzle having an upstream end adapted for removable fitment to a gas torch and a downstream-end for discharge of burning mixed oxygen and fuel gas within a geometric annulus surrounding a central axis, the nozzle comprising a body adapted at its upstream-end for end-to-end assembly to a gas torch, said body having mixing-chamber means near the downstream end and concentrically distributed about said axis, said body also having a plurality of mixed-gas discharge passages connecting said mixing-chamber means for nozzle discharge and separate first and second inlet passage means adapted to receive independent flows of inlet fuel gas and inlet oxygen and having independent communication with said mixing-chamber means, the improvement wherein the inlet-passage means for fuel-gas supply includes an elongate cylindrical manifold surrounding the inlet-passage means for oxygen, said cylindrical manifold having circumferentially distributed communication with said mixing-chamber means.

18. The improvement of claim 17, wherein said mixing-chamber means is an annular mixing manifold about said axis.

19. The improvement of claim 17, wherein said mixing-chamber means comprises a plurality of like radially inwardly directed independent fuel-gas passages, and wherein the inlet-passage means for oxygen comprises a similar plurality of independent longitudinally extending passages each of which intersects a different one of said radially inward passages, said cylindrical manifold communicating in common with all said radially inward passages.

* * * * *